United States Patent [19]

Tang et al.

[11] Patent Number: 4,881,051

[45] Date of Patent: Nov. 14, 1989

[54] DIELECTRIC IMAGE-RESONATOR MULTIPLEXER

[75] Inventors: Wai-Cheung Tang, Kitchener, Canada; Richard J. Cameron, High Wycombe; David M. T. Bryant, Abbots Langley, both of England

[73] Assignee: Com Dev Ltd., Cambridge, Canada

[21] Appl. No.: 227,788

[22] Filed: Aug. 3, 1988

[30] Foreign Application Priority Data

Apr. 5, 1988 [CA] Canada ..... 563315

[51] Int. Cl.[4] ..... H01P 1/20

[52] U.S. Cl. ..... 333/208; 333/135; 333/202; 333/219.1; 333/212

[58] Field of Search ..... 333/110, 134, 135, 202, 333/208-212, 219, 219.1, 235, 227, 231, 248; 370/38, 123

[56] References Cited

U.S. PATENT DOCUMENTS 4,121,181 10/1978 Nishikawa et al. ..... 333/202
4,423,397 12/1983 Nishikawa et al. ..... 333/227

FOREIGN PATENT DOCUMENTS 467534 11/1976 U.S.S.R. ..... 333/134

*Primary Examiner*—Eugene R. Laroche
*Assistant Examiner*—Seung Ham
*Attorney, Agent, or Firm*—Daryl W. Schnurr

[57] ABSTRACT

A two, three or four channel multiplexer can be operated in the $TE_{01\delta}$ or $HE_{11\delta}$ modes, each channel of the multiplexer has one bandpass filter, with each filter usually having a plurality of cavities. One cavity of each filter is a common cavity with all of the other filters of the multiplexer. The common cavity contains one independent dielectric quarter-cut or half-cut image resonator for each filter representing a channel of the multiplexer. Each resonator is mounted on a suitable support the common cavity provides a common junction and contains a loop coupling to couple electromagnetic energy between the various channels. The multiplexer has at least one input and at least one output. Previous microwave multiplexers have a plurality of bandpass filters arranged on a coaxial manifold. With the multiplexer of the present invention, the manifold can be eliminated. Further, at the S-band or L-band, substantial weight and volume savings can be achieved using the multiplexer of the present invention without sacrificing performance. This can be very important for space applications.

26 Claims, 7 Drawing Sheets

PRIOR ART

DIELECTRIC IMAGE-RESONATOR MULTIPLEXER

BACKGROUND OF THE INVENTION

1. Field of the Invention

This invention relates to microwave multiplexers for use in satellite communications and, in particular, to multiplexers having two to four channels and containing a plurality of independent dielectric cut resonators where the total number of cut resonators exceeds the number of cavities in the multiplexer.

2. Description of the Prior Art

Previous microwave multiplexing networks have a pluality of bandpass filters suitably arranged on a coaxial manifold. Presently, space-application microwave filters with passbands centered between 1 and 4 GHz have generally employed coaxial resonator (re-entrant) cavities for the realization of the filter resonator elements. These coaxial filters can be operated to produce satisfactory results.

Above 4 GHz, low power waveguide filter cavities may conveniently be replaced by single or dual mode dielectric resonators. This results in very significant mass and volume savings for the filter without degradation to the overall electrical performance. These types of dielectric-loaded structures have been described by S. J. Fiedziuszko (IEEE MTT-30, No. 9, Sept., 1982, pp. 1311-1316) and W. C. Tang, et al. U.S. Pat. No. 4,675,630 entitled Triple Mode Dielectric Loaded Bandpass Filters and U.S. Pat. No. 4,652,843 entitled Planar Dielectric Resonator Dual-Mode Filter). If these dielectric resonators are used to replace coaxial cavities at S-band or L-band, the resulting overall filter may actually end up heavier than the coaxial filters that are replaced. Moreover, the power handling capability will be reduced and the far out-of-band spurious response behaviour will be worse as compared to the coaxial technology. Although the insertion loss of the dielectric filter will be lower, this advantage is outweighted by its drawbacks as far as most space applications are concerned. For these reasons, coaxial cavity filters have generally been used in space applications in the S-band or L-band and have not been replaced by dielectric resonator filters.

It is known to construct high power bandpass filters by cascading single quarter-cut image resonators (see IEEE MTT-S International Microwave Symposium Digest, June 9-11, 1987, pp. 133-136, published by T. Nishikawa, et al. and entitled "Dielectric High-Power Bandpass Filter Using Quarter-Cut $TE_{01\delta}$ Image Resonator for Cellular Base Stations"). This structure provides high handling capability and is thus suitable for cellular radio application. However, it is not suitable for space applications. The filter uses a single mode configuration and is larger in mass and volume relative to dielectric resonator filters operating in the dual-mode configuration.

SUMMARY OF THE INVENTION

It is an object of the present invention to provide a multiplexer having two to four channels and one cavity that is a common cavity and contains a cut dielectric image resonator for each of the channels of the multiplexer.

A multiplexer has two, three or four channels and each channel has one bandpass filter. Each filter has at least one cavity with said at least one cavity of each filter being a common cavity with all of the other filters of the multiplexer. The common cavity contains one independent dielectric cut image resonator for each filter representing a channel of the multiplexer. Each resonator is mounted on a suitable support. The common cavity provides a common junction and contains means to couple electromagnetic energy between the various channels, said multiplexer having at least one input and at least one output.

BRIEF DESCRIPTION OF THE DRAWINGS

In drawings which illustrate a preferred embodiment of the invention:

FIG. 1(*b*) is a top view of the electric and magnetic field patterns for a prior art dielectric disc positioned at the centre of a cubical metal cavity resonating in a $TE_{01\delta}$ mode;

FIG. 1(*c*) is a side view of the electric and magnetic field patterns for a prior art dielectric disc positioned at a centre of a cubical meal cavity resonating in an $HE_{11\delta}$ hybrid mode;

FIG. 1(*d*) is a top view of prior art electric and magnetic field patterns for a dielectric disc positioned at the centre of a cubical metal cavity and resonating in an $HE_{11\delta}$ hybrid mode;

FIG. 2(*b*) is a top view of four square cavities, each cavity containing a quarter-cut dielectric resonator, the cavities being created by two orthogonal metallic septae which separate the quarter-cut resonators from one another and create the four cavities;

FIG. 3(*b*) is a top view of the resonators of FIG. 3(*a*);

FIG. 3(*c*) is a side view of four quarter-cut dielectric resonators, the resonators being separated by two orthogonal metallic septae;

FIG. 3(*d*) is a top view of the resonators of FIG. 3(*c*);

FIG. 4(*b*) is a top view of a ninth degree asymmetric filter where the number of quarter-cut dielectric resonators exceeds the number of cavities;

FIG. 6(*b*) is a three channel multiplexer containing twelve quarter-cut dielectric resonators and nine cavities;

FIG. 6(*c*) is a three channel multiplexer containing ten quarter-cut dielectric resonators, two half-cut dielectric resonators and having eight cavities;

FIG. 7(*b*) is a four channel multiplexer containing sixteen quarter-cut dielectric resonators and having thirteen cavities.

DESCRIPTION OF A PREFERRED EMBODIMENT

Figure 1A:
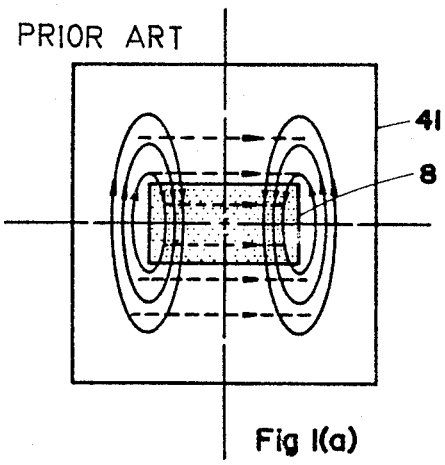
Fig 1(a) PRIOR ART
FIG. 1(*a*) is a side view of the electric and magnetic field patterns for a prior art dielectric disc positioned at a centre of a cubical metal cavity resonating in a $TE_{01\delta}$ mode.
Figure 1C:
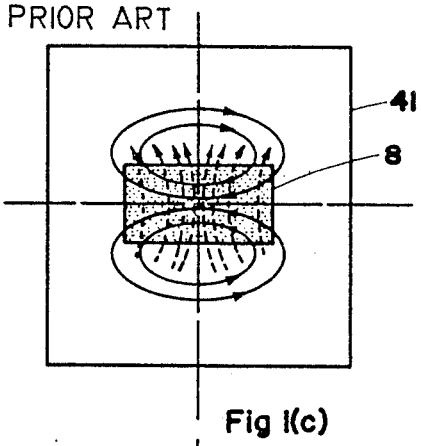
Fig 1(c) PRIOR ART
Figure 1B:
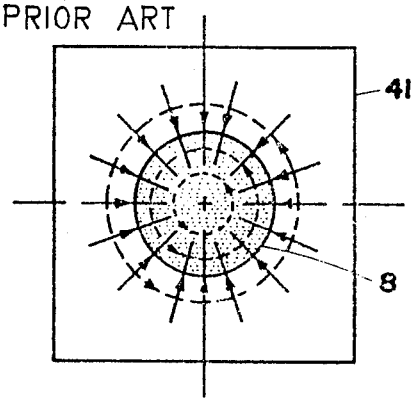
Fig 1(b) PRIOR ART
Figure 1D:
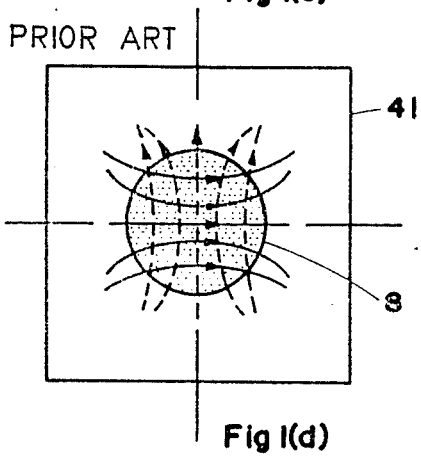

Referring to the drawings in greater detail, the electric field patterns in FIGS. 1(*a*), 1(*b*), 1(*c*) and 1(*d*) are shown by dotted lines having arrows on them and the magnetic field patterns are shown by solid lines having arrow on them. FIGS. 1(*a*) and 1(*b*) show the electromagnetic field patterns for the $TE_{01\delta}$ mode and FIGS. 1(*c*) and 1(*d*) show the electromagnetic field patterns for the $HE_{11\delta}$ mode. In each of FIGS. 1(*a*), 1(*b*), 1(*c*) and 1(*d*), there is a dielectric resonator 8 in a cavity 41. The resonator 8 has a cylindrical shape and is uncut. It is impossible to operate two orthogonally independent $TE_{01\delta}$ modes in the same dielectric resonator cavity but it is possible to do so with the $HE_{11\delta}$ mode. By coupling the magnetic and electric fields of the two modes in one cavity separately into the corresponding fields of an adjacent dual mode cavity, it is possible to provide couplings between non-sequential resonance (cross-couplings) which allow for the realization of advanced transfer characteristics such as the pure- or quasi-elliptic or group delay equalized classes. However, the topological restrictions are such that only the symmetric cross-couplings may be implemented and therefore only symmetric characteristics may be realized with this configuration.

The symmetries and patterns of the electromagnetic fields shown in FIGS. 1(*a*), 1(*b*), 1(*c*) and 1(*d*) may be exploited to create a quasi multi-mode of resonance within the cavity. Dealing with the $TE_{01\delta}$ mode shown in FIGS. 1(*a*) and 1(*b*) first, if a metallic plane (or septum) is inserted through the one access of symmetry, which is shared with both the dielectric disc and the cavity and is fixed to the centre lines of two opposing walls of the cavity, thereby splitting the dielectric disc 8 of FIGS. 1(*a*) to 1(*d*), inclusive, into two 'D'-shaped halves 10 (see FIG. 2(*a*)), it can be seen that no disturbance to the lines of the electromagnetic field of the $TE_{01\delta}$ resonance will occur. Each half-cut dielectric resonator 10 in FIG. 2(*a*) is in its own separate cavity 41. The electric field lines, being dotted, will meet the metallic plane perpendicularly everywhere while the magnetic field lines (being solid) adjacent to the surface of the metallic plane are parallel to the plane everywhere. The conditions for the existence of an electromagnetic field within the metallic cavity remain satisfied. A similar analysis and result can be achieved by studying the electromagnetic field patterns of the $HE_{11\delta}$ mode shown in FIGS. 1(*c*) and 1(*d*).

Figure 2A:
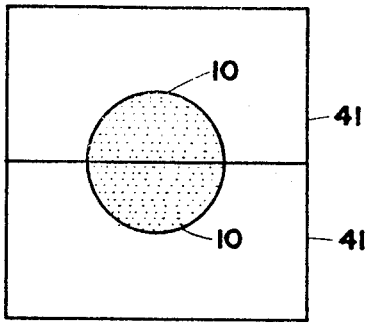
FIG. 2(*a*) is a top view of two rectangular cavities, each cavity containing a half-cut dielectric resonator, the two half-cut resonators being separated by a single metallic septum which creates the two cavities.
Figure 2B:
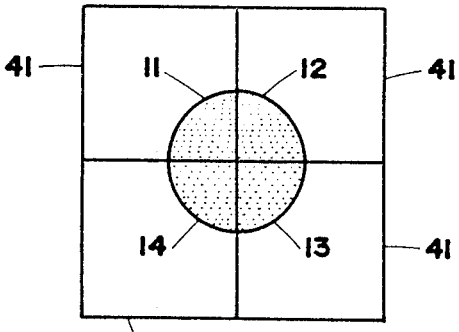
Figure 3A:
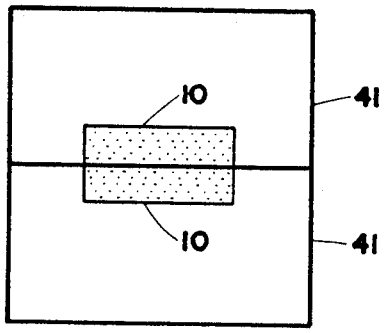
FIG. 3(*a*) is a side view of two cavities, each containing a half-cut dielectric resonator, the resonators being separated from one another by a single metallic septum that also creates the two cavities, the septum being normal to a centre axis of the resonator.
Figure 3C:
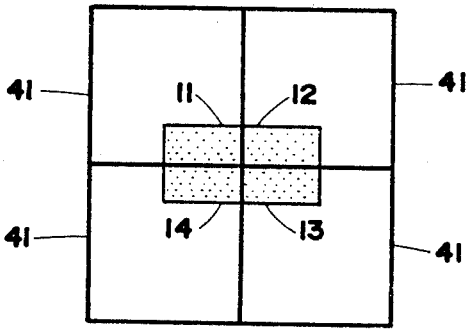
Figure 3B:
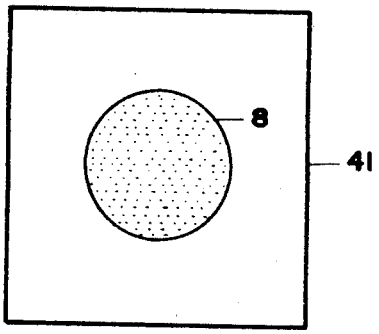
Figure 3D:
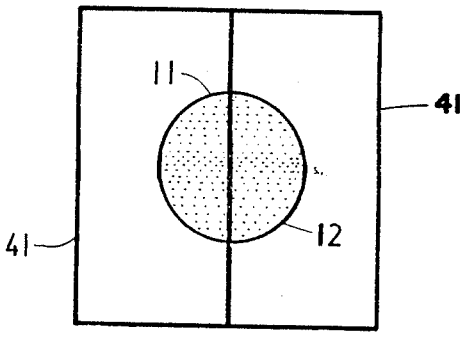

Since the two cavities 41 and the two half-cut resonators 10 are electromagnetically isolated from each other by the septum, one half-cut dielectric disc 10 may be completely removed and the other half-cut disc 10 will continue to resonate as before. The missing half will have been in effect substituted by the image of the remaining half, as if it were looking into an electromagnetic mirror. The frequency of resonance will remain unchanged and the Q-factor will be slightly degraded due to some extra currents flowing in the magnetic septum. As shown in FIG. 2(*b*), the concept may be further extended by inserting another septum, orthogonal to the first septum shown in FIG. 2(*a*) and dividing the dielectric disc into four equal quarter-cut dielectric resonators 11, 12, 13, 14. Each resonator 11, 12, 13, 14 is in its own separate cavity 41 and will resonate independently as if the complete dielectric disc was present, even though three-quarters of the disc is made up of images of a single quadrant as seen in an electromagnetic kaleidoscope.

The diameter, height and dielectric constant of the dielectric disc and to a lesser extent the dimensions of the cavity control the frequency of resonance and limited adjustment may be made with an appropriately placed screw. The dimensions of the cavity are arranged to be evanescent to all waveguide modes over the band of interest. The Q-factor of the resonator, which is a measure of the RF insertion loss that will occur when the resonator is used as part of a filter network, is a function of the conductivity of the metal of the cavity and, more importantly, the displacement current loss of the dielectric material itself. Couplings to adjoining cavities are through probes or apertures in the common wall of the septum separating two or more resonators. The input/output couplings are usually probes.

The disc is supported at the centre of a cavity upon a tubular pedestal (not shown) which itself should have a low loss and a relative dielectric constant somewhere between unity and that of the disc. The tubular pedestal or support for the dielectric disc is conventional. This usually means that a ceramic or crystalline material, for example, alumina or quartz, is used. Both of these are rather poor conductors of heat and that is the dominant factor preventing the use of this type of resonator for high power applications. The bulk of any lost RF energy is dissipated within the high-dielectric disc and the disc would tend to overheat if an efficient thermally-conducting path to a cooling surface is not provided. The internal regions of the dielectric disc are those where the strongest fields exist and therefore where the greatest RH dissipation in temperature rises occur. The metallic septae will be in close proximity and have direct thermo-contact with these regions and will provide a convenient heat sink for the dissipated heat. This will significantly increase the power handling capability of each resonator and of any filter of which they comprise.

For the $HE_{11\delta}$ mode, the field patterns of which are shown in FIGS. 1(*c*) and 1(*d*), it can be seen that a metallic plane can be inserted normal to the axis of the disc halfway up its height without disturbance of the field patterns. As shown in FIGS. 3(*a*) and 3(*b*), a dielectric disc has been divided into two half-cut resonators 10 by the insertion of a septum perpendicular to the centre axis of the resonator, the septum dividing the resonator in half. Each half-cut resonator is in its own separate cavity 41, there being one cavity for each resonator. All electric lines of the $HE_{11\delta}$ resonant mode are perpendicular to this intersecting plane, and all magnetic lines are parallel to the plane at its surface such that each half-height disc resonates as before. The images of the discs in the imaginary electromagnetic mirrors effectively restores the discs to full-height discs.

As shown in FIGS. 3(*c*) and 3(*d*), as with the TE-mode resonance, a second septum may be inserted through the dielectric disc effectively dividing the original resonator into four independent quarter-cut resonators 11, 12, 13, 14, each with the same resonant frequency and a similar Q-factor to the disc as a whole. Each quarter-cut resonator 11, 12, 13, 14 is located in its own separate cavity 41, there being one cavity for each resonator. The second septum must satisfy the same electromagnetic conditions as the first concerning the directions of the electric and magnetic field lines and it may be seen that a possibility exists to insert a magnetic plane perpendicular to the first plane and running through the common cavity and disc access of symmetry as shown in FIGS. 3(*c*) and 3(*d*). The original disc is shown as being divided in four 'D'-shaped segments each of which has one top surface and a straight-edge surface in contact with metal. For this reason, this configuration potentially has even greater power-handling capability than the TE-mode image resonator.

By using four orthogonal metal septae, four independent resonances (in four independent resonators) may be supported with the same centre frequency and Qfactor as with the original undivided dielectric disc within the same size of cavity. Coupling is established between these four independent resonators by introducing coupling apertures through the metal septae, which separate the quarter-cut resonators. Probe coupling is also used through the metal septae where it is desired to couple between non-adjacent resonators. Couplings between independent quarter-cut resonators provided filtering characteristics having arbitrary response functions. Reductions in volume of 75% and almost as much in mass may be achieved over the equivalent single mode $TE_{01\delta}$ dielectric resonator filter. Further, since coupling apertures may be implemented in the common septum between adjacent quarter-cut resonators close to regions of concentrated field strength within the dielectric quadrants, wide passband filter characteristics, which require the stronger couplings, may be realized.

Another advantage is that the arrangement of the septae within the cavity results in minimum disturbance to the desired mode, whether it be a $TE_{01\delta}$ mode or an $HE_{11\delta}$ mode. Since the septae are placed, as described above, so as not to disturb the field patterns of the desired mode, any other higher-ordered mode will have a field pattern with electric field components parallel to the metallic plane and will tend to be suppressed. Also, since the segment of the cavity is of a smaller size than cavities used in previous filters or multiplexers, undesirable waveguide modes will not tend to propagate until much higher frequencies. Both of these factors will tend to suppress unwanted modes of resonance within the cavity and assure a very wide spurious-free reject-band.

The multiplexer can be operated to realize symmetric and asymmetric cross-couplings through the use of probes or loops. When utilizing the $HE_{11\delta}$ mode, as an alternative to the second metallic septum orthogonal to the first septum, the half-height dielectric discs may be operated in a dual-mode fashion. This may not be as good for spurious mode suppression but the implementation is simpler and the cross-coupling screw may be easily adjusted. Only symmetric cross-couplings may be implemented with this hybrid configuration.

Figure 4A:
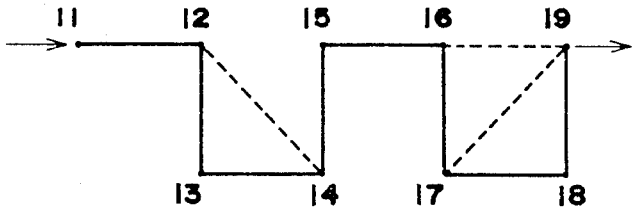
FIG. 4(*a*) is a coupling diagram for the ninth degree asymmetric filter of FIG. 4(*b*)
Figure 4B:
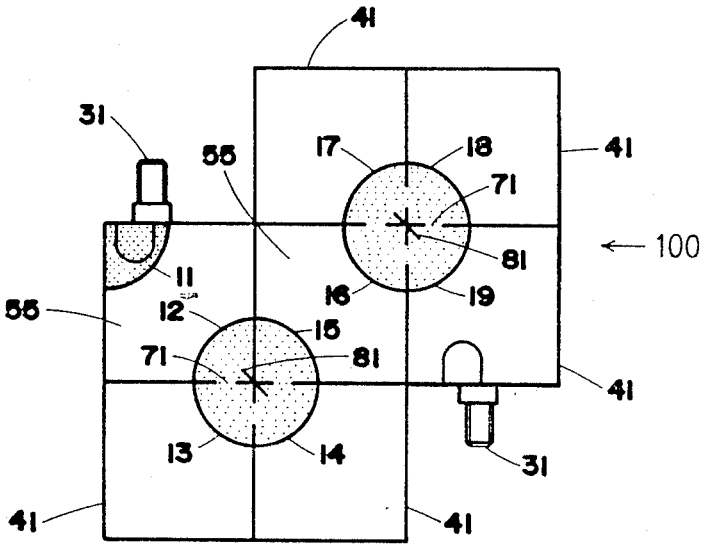

In FIG. 4(*b*), there is shown a ninth degree elliptic bandpass filter 100. The filter 100 has five cavities 41 and two cavities 55 for a total of seven cavities. The cavities are arranged in two large overlapping squares with the first four cavities forming the first square and the fourth, fifth, sixth and seventh cavities forming the second square. The fourth cavity is a common cavity of the two large squares. Each of the cavities contains at least one quarter-cut dielectric resonator but the first and fourth cavities 55 each contain two quarter-cut dielectric resonators. An input loop 31 couples energy to the first quarter-cut dielectric resonators 11 in the first cavity. Energy is coupled from the dielectric resonator 11 to the dielectric resonator 12, also located in the first cavity 55, by proximity coupling. Energy is coupled from the resonator 12 to the resonator 13 through aperture 71. All of the apertures of the filter 100 are apertures 71 but some of the apertures are not referred to by reference numerals so that the drawings would not be overcrowded. It will be noticed that reference numerals have been omitted for other components as well for the same reason. Energy is coupled from the resonator 13 in the second cavity 41 to the resonator 14 in the third cavity 41 through the aperture 71 between these two cavities. Energy is coupled from the resonator 14 of the third cavity to the resonator 15 of the fourth cavity through the aperture 71 between these two cavities. Cross-coupling occurs between the resonator 12 and the resonator 14 through coupling probe 81.

Energy is coupled from the resonator 15 in the fourth cavity 55 to the resonator 16 in the fourth cavity 55 by proximity coupling. Energy is coupled from resonator 16 in the fourth cavity to resonator 17 in the fifth cavity through aperture 71 between these two cavities. Energy is coupled from the resonator 17 in the fifth cavity to the resonator 18 in the sixth cavity through aperture 71 between these two cavities. Energy is coupled from resonator 18 in the sixth cavity to resonator 19 in the seventh cavity through aperture 71 located between these two cavities. Cross-coupling occurs between the resonator 17 and the resonator 19, which are not adjacent to one another, through coupling probe 81. Cross-coupling occurs between the resonator 19 of cavity 7 and the resonator 16 of cavity 4 through the aperture 71 between these two cavities. Energy is coupled from resonator 19 to output coupling loop 31 to extract the filtered output from the filter. In this way, energy is coupled sequentially through the resonators in numerical order from the input 31 of the first cavity to the output 31 of the seventh cavity. It can be seen that resonators 12, 13, 14, 15 are located at a common intersection of septae for the first, second, third and fourth cavities. Similarly, resonators 16, 17, 18 and 19 are located at a common intersection of septae for the fourth, fifth, sixth and seventh cavities.

In FIG. 4(*a*), the coupling diagram for the filter 100 of FIG. 4(*b*) is shown. The solid lines show the main couplings and the dotted lines show the crosscouplings. The reference numerals correspond to the reference numerals of the resonators shown in FIG. 4(*b*).

Throughout this specification, the resonators will be numbered consecutively in their general order of coupling commencing at reference numeral 11. In some multiplexers of filters, there will be more than one possible order of coupling. Cavities with only one quarter-cut dielectric resonator will be designated as cavities 41 and cavities with two or more dielectric resonators in a filter, other than the common cavity, will be designated as cavities 55. The common cavity of a multiplexer, being the cavity that is common to each channel of the multiplexer, will be designated by reference numeral 51. Cavities that are divided in half by an extra septum to create two more cavities will each be designated by reference numeral 45. The same numbering system is used throughout the drawings to assist in making the drawings as simple to understand as possible.

Figure 5:
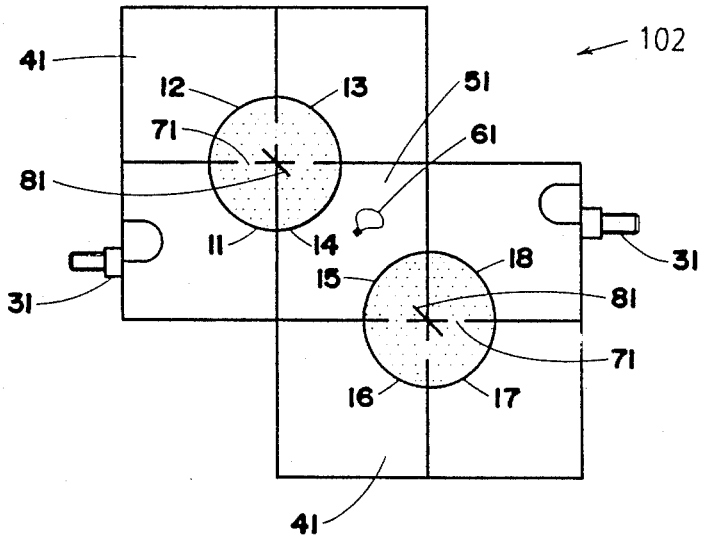
FIG. 5 is a top view of a two channel multiplexer containing a plurality of quarter-cut dielectric resonators.

In FIG. 5, there is shown a two-channel multiplexer 102, each channel having a common cavity 51. Depending on how the multiplexer is operated, energy can be coupled into the multiplexer through the two input probes 31 and out of the multiplexer trough a coupling loop 61. Alternatively, energy can be coupled into the multiplexer through the coupling loop 61 and out of the multiplexer through the two coupling probes 31. The common cavity 51 provides a common junction and contains means to couple electromagnetic energy between the various channels of the multiplexer. The means to couple electromagnetic energy between the various channels is a coupling loop 61.

In one desired form of operation, energy is coupled from the input probe 31 to the resonator 11 located in the first cavity 41. Energy is sequentially coupled from the resonator 11 in the first cavity to the resonator 12 in the second cavity through the aperture 71 located between the first and second cavities. Energy is coupled from the resonator 12 of the second cavity to the resonator 13 of the third cavity through the aperture 71 located between the second and third cavities. Energy is coupled from the resonator 13 of the third cavity 41 to the resonator 14 of the common cavity 51 through the aperture 71 located between these two cavities. Energy is coupled through cross-coupling from the resonator 14 to the resonator 12 through coupling probe 81. Resonator 14 of the first channel and resonator 15 of the second channel are both located within the common cavity 51. Energy is coupled between the loop 61 and the resonators 14, 15 in the fourth cavity 51. Energy is coupled from the resonator 15 located in the fourth cavity 51 to the resonator 16 located in the fifth cavity 41 through aperture 71 located between these two cavities. Energy is coupled from the resonator 16 of the fifth cavity to the resonator 17 of the sixth cavity 41 through aperture 71 located between these two cavities. Energy is coupled between the resonator 17 of the sixth cavity and the resonator 18 of the seventh cavity 41 through aperture 71 located between these two couplings. Cross-coupling occurs between resonators 15 and 17 through coupling probe 81. Energy is coupled between the resonator 18 and the input/output probe 31 of the seventh cavity 41. The first channel of the multiplexer includes resonators 11, 12, 13, 14 and the first four cavities. The second channel of the multiplexer includes resonators 15, 16, 17, 18 and the fourth, fifth, sixth and seventh cavities. Resonators 11, 12, 13, 14 of the first channel are located at a common intersection of septae and resonators 15, 16, 17, 18 of the second channel are located at a common intersection of septae. The multiplexer 102 has eight quarter-cut resonators and seven cavities. The resonators 11, 12, 13, 14 are oriented in a form of a circle as are the resonators 15, 16, 17, 18.

Figure 6C:
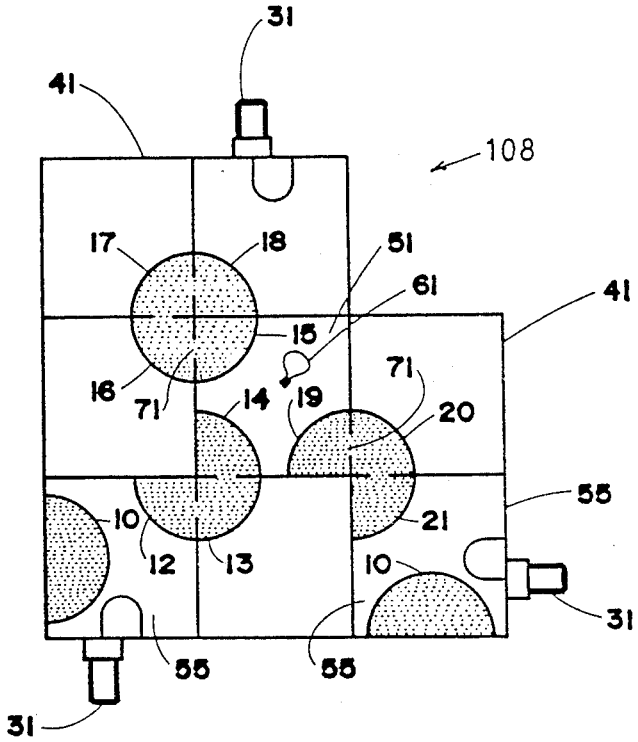
FIG. 6(*a*) is a top view of a three channel multiplexer containing twelve quarter-cut dielectric resonators and eight cavities.
Figure 6A:
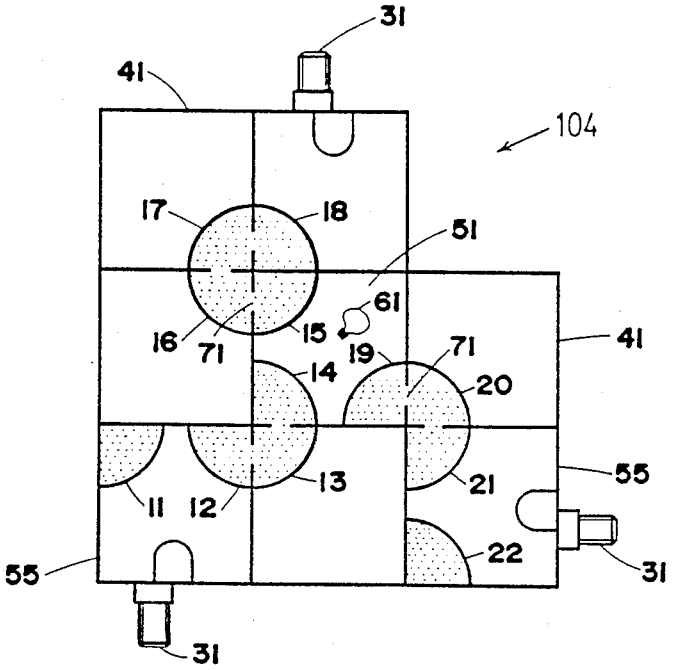
Figure 6B:
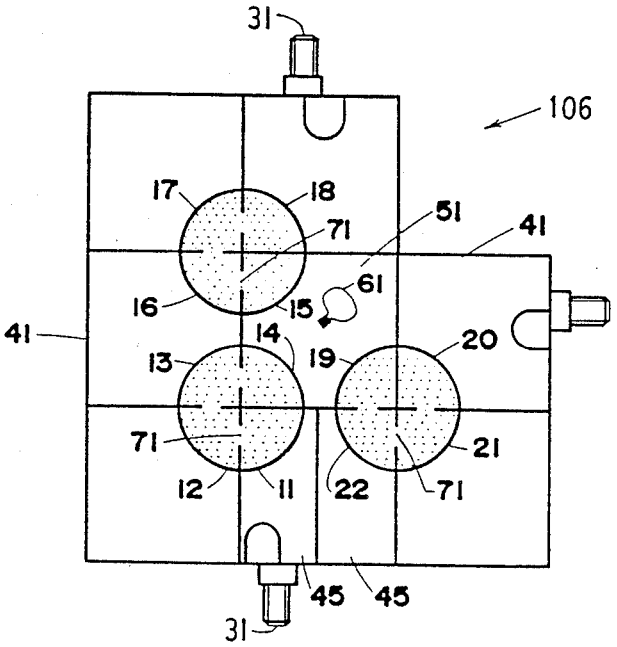

In FIG. 6(*a*), there is shown a three-channel multiplexer 104 which operates in a manner similar to the multiplexer 102. The multiplexer 104 has twelve independent quarter-cut resonators and eight cavities. The common cavity 51 contains three independent quarter-cut dielectric resonators 14, 15, 19, each of said resonators representing a different channel of the multiplexer. As with the multiplexer 102, energy can be coupled into the multiplexer through the three input/output probes 31 and energy can be coupled out of the multiplexer through the common loop 61 or vice-versa One method of operating the multiplexer 104 is to couple energy from the input 31 to the resonator 11 located in the first cavity 55. Energy is then coupled by proximity coupling from the resonator 11 to the resonator 12 also located within the first cavity Energy is coupled from the resonator 12 to the resonator 13 of the second cavity through aperture 71 between these two cavities. Energy is coupled from the resonator 13 to the resonator 14 of the common cavity 51 through aperture 71 between these two cavities. Energy is coupled between resonator 14 and resonator 15 through coupling loops 61. Energy is coupled from resonator 15 of the third cavity to resonator 16 of the fourth cavity through aperture 71 between these two cavities. Energy is coupled from resonator 16 of the fourth cavity to resonator 17 of the fifth cavity through aperture 71 between these two cavities. Energy is coupled from resonator 17 of the fifth cavity to resonator 18 of the sixth cavity through aperture 71 between these two cavities. Energy is coupled between the resonator 18 and the input/output probe 31 located within the sixth cavity 41. Energy is coupled between the resonators 14, 15 and 19 through the coupling loop 61. Energy is coupled from the resonator 19 of the third cavity to the resonator 20 of the seventh cavity 41 through aperture 71 located between these two cavities. Energy is coupled from the resonator 20 of the seventh cavity 41 to resonator 21 of cavity 55 through aperture 71 located between these two cavities. Energy is coupled from resonator 21 to resonator 22 within the same cavity 8 by proximity coupling. Energy is coupled between the resonator 22 and the input/output probe 31 of the cavity 8.

In FIG. 6(*b*), there is shown a three-channel multiplexer 106 which functions in a similar manner as the multiplexers 102 and 104. The common cavity 51 contains the coupling loop 61 and resonators 14, 15 and 19, said resonators each representing a different channel of the multiplexer 106. The multiplexer has nine cavities and a total of twelve quarter-cut resonators. Each cavity contains one quarter-cut resonator except for the common cavity 51. The main variation between multiplexer 104 and multiplexer 106 is that the multiplexer 106 has one extra cavity that was created by dividing one of the cavities in half by locating an extra septum therein to create two smaller cavities 45. The first channel includes resonators 11, 12, 13, 14. The second channel includes resonators 15, 16, 17, 18 and the third channel includes resonators 19, 20, 21, 22. All of the resonators of each channel are located at a common intersection of septae and, except for the common channel 51, there is only one quarter-cut resonator per channel. As the multiplexer 106 operates in a manner similar to the multiplexers 102, 104, the operation of the multiplexer 106 will not be described in detail.

In FIG. 6(*c*), there is shown a three-channel multiplexer 108. The variation between the multiplexer 108 and the multiplexer 104 is that the multiplexer 108 contains two independent half-cut resonators 10 that are located in two different channels 55. One of the halfcut resonators is located in the first channel and one of the half-cut resonators is located in the third channel. In each case, energy is coupled between the input/output probe 31 and the half-cut resonator 10. Energy is then coupled by proximity coupling between the half-cut resonator 10 of the first cavity 55 and the resonator 12 located in the same cavity and energy is coupled from the half-cut resonator 10 in the eighth cavity 55 and the resonator 21 of the same cavity by proximity coupling. The first channel includes resonators 10, 12, 13, 14, the second channel includes resonators 15, 16, 17, 18 and the third channel includes resonators 19, 20, 21 and 10.

Since the multiplexer 108 operates in a manner similar to multiplexers 102 and 104, the operation of the multiplexer 108 is not described in detail. As can be seen, the half-cut resonators 10 are 180° sectors and the quarter-cut resonators are 45° sectors.

Figure 7A:
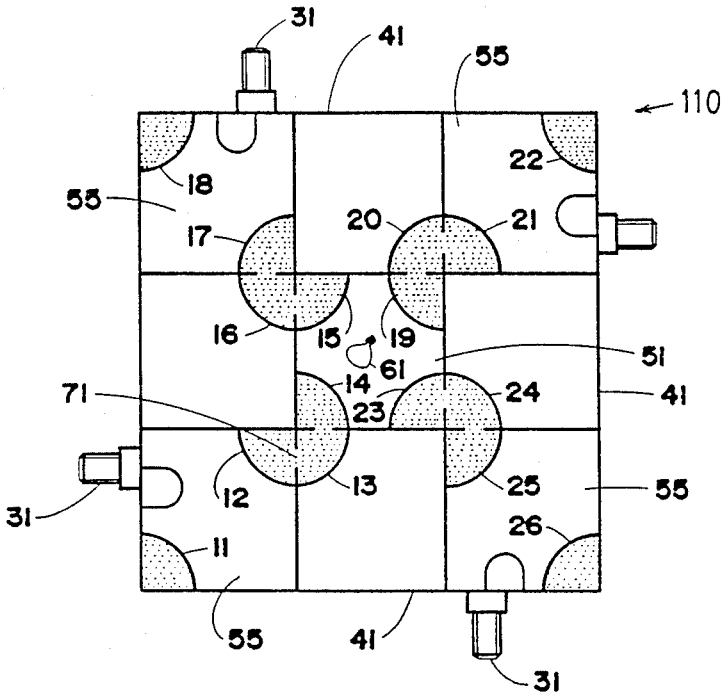
FIG. 7(*a*) is a four channel multiplexer containing sixteen quarter-cut dielectric resonators and having nine cavities.
Figure 7B:
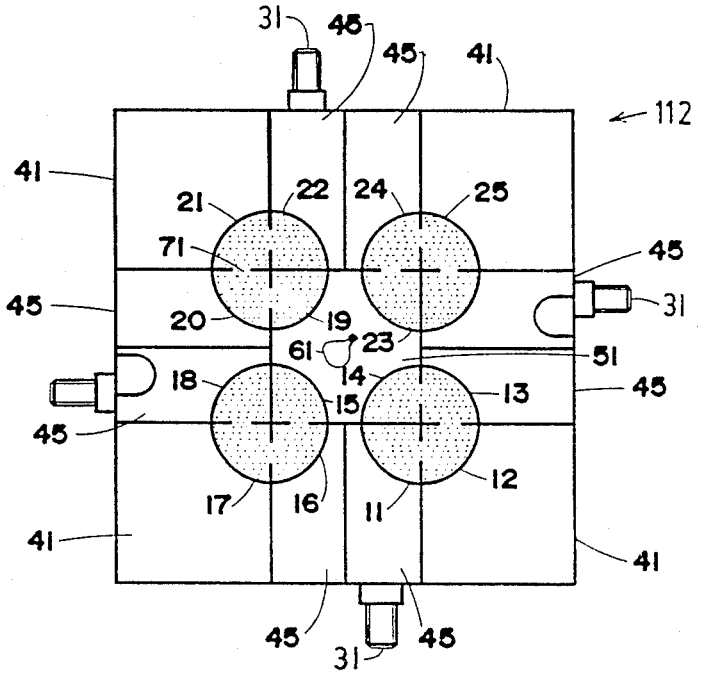

In FIG. 7(*a*), there is shown a four-channel multiplexer 110. The multiplexer 110 has sixteen quarter-cut resonators and nine cavities. The common cavity is cavity 51 which contains coupling loop 61 and four quarter-cut resonators 14, 15, 19, 23, one of said resonators representing each channel of the multiplexer. The first channel of the multiplexer includes resonators 11, 12, 13, 14. The second channel of the multiplexer includes resonators 15, 16, 17, 18 and the resonators of the second channel are arranged in a manner similar to those of the first channel. The third channel of the multiplexer includes resonators 19, 20, 21, 22 and these resonators are also arranged in a manner similar to those of the first channel. The fourth channel includes resonators 23, 24, 25, 26 and these resonators are also arranged in a manner similar to those of the first channel. Excluding the common cavity 51, each channel has one cavity that contains two quarter-cut resonators. The remaining cavity of each channel, other than the common cavity, contains one dielectric resonator. Each channel of the multiplexer 110 contains three cavities, including the common cavity and four quarter-cut resonators. Since the operation of the multiplexer 110 is similar to the operation of the multiplexers 102 and 104, the operation of the multiplexer 110 will not be described in detail. It should be noted that the multiplexer 110 of FIG. 7(*a*) is a symmetrical structure.

In FIG. 7(*b*), there is shown a four-channel multiplexer 112. It should be noted that the multiplexer 112 is also a symmetrical structure. The multiplexer 112 has sixteen quarter-cut resonators and thirteen cavities. Eight of the cavities are cavities 45 that were created by dividing a larger cavity in half by adding an additional septum. The common cavity is cavity 51 and it contains four quarter-cut resonators 14, 15, 19, 23, each of said resonators representing a different channel. The four resonators of each channel are located at a common intersection of septae. The first channel contains resonators 11, 12, 13, 14. The second channel contains resonators 15, 16, 17, 18. The third channel contains resonators 19, 20, 21, 22 and the fourth channel contains resonators 23, 24, 25, 26. The resonators of each channel are arranged in a manner similar to the resonators of all of the other channels.

The method for designing filters and multiplexers in accordance with the present invention using independent dielectric-cut resonators, preferably being quarter-cut or half-cut resonators, is the same as that using waveguide cavities operating in single or dual-mode configurations. The quarter-cut image resonators provide the equivalent of a waveguide resonator while the aperture and probe couplings through the metal septae provide all of the flexibility to realize the general transfer functions.

Having generated the transfer and reflection polynomials ($S_{21}$ and $S_{11}$) for the required filter characteristic, the next step in the design procedure is to synthesize the prototype network from the polynomials. For this case, one of the more suitable networks that emerges from the synthesis procedure will have the form as shown in FIG. 4(*a*). Here the nodes at the end of each solid line represent resonances, the solid lines interconnecting them are main (sequential) couplings and the dotted lines are cross-couplings (non-sequential). The diagonal cross-couplings are those that produce the asymmetry in the filter characteristic. If they are not present, a symmetric filter characteristic will result. Therefore, if one wishes to produce a symmetric result, one can simply eliminate the coupling probes 81.

The topology of this network may be directly mimicked by the dielectric resonator quadrants and the interconnections by probes or apertures in the dividing septae or by proximity, as shown in FIG. 4(*b*). As can readily be seen, this entire ninth degree filter occupies a volume a little less than that of two cavities of the same filter realized with nine conventional single-mode dielectric resonators, one resonator per cavity. Similar volume and weight savings are achieved in the multiplexers of the present invention over those of the prior art multiplexers.

What we claim as our invention is:

1. A multiplexer comprising two, three or four channels, each channel having one bandpass filter, each filter having at least one cavity, said at least one cavity of each filter being a common cavity with all of the other filters of the multiplexer, said common cavity containing one independent dielectric cut image resonator for each filter representing a channel of said multiplexer, each resonator being mounted on a suitable support, said common cavity providing a common junction and containing a means to couple electromagnetic energy between the various channels, said multiplexer having at least one input and at least one output.

2. A multiplexer as claimed in claim 1 wherein the means to couple electromagnetic energy between the various channels is a loop coupling located in the common channel.

3. A multiplexer as claimed in claim 2 wherein the independent dielectric cut image resonators are selected from the group of half-cut resonators and quarter-cut resonators.

4. A multiplexer as claimed in claim 3 wherein at least one filter in the multiplexer has a plurality of cavities.

5. A multiplexer as claimed in claim 4 wherein the common cavity contains one quarter-cut dielectric resonator for each filter representing a channel of the multiplexer.

6. A multiplexer as claimed in claim 4 wherein the independent dielectric cut image resonators are selected from the group of half-cut dielectric resonators and quarter-cut dielectric resonators but are mainly quarter-cut dielectric resonators.

7. A multiplexer as claimed in claim 2 wherein at least one filter has a plurality of cavities and has one cavity, other than the common cavity, containing a plurality of cut image resonators.

8. A multiplexer as claimed in claim 7 wherein the independent dielectric cut resonators in said one cavity are half-cut resonators.

9. A multiplexer as claimed in claim 7 wherein the independent dielectric cut resonators are quarter-cut resonators.

10. A multiplexer as claimed in claim 4 wherein the cavities have a rectangular cross-section, each cavity having walls formed of metal septae.

11. A multiplexer as claimed in claim 4 wherein a majority of the cavities have a square cross-section.

12. A multiplexer as claimed in any one of claims 2, 5 or 9 wherein the number of independent one quarter-cut resonators in a single cavity ranges from one to four.

13. A multiplexer as claimed in any one of claims 10 or 11 wherein electromagnetic energy is coupled between resonators at a common intersection of septae by coupling through apertures between adjacent cut resonators, said apertures being appropriately located in said septae.

14. A multiplexer as claimed in any one of claims 2, 5 or 10 wherein electromagnetic energy is coupled between independent one quarter-cut resonators of the same cavity, other than the common cavity, by proximity coupling.

15. A multiplexer as claimed in claim 10 wherein electromagnetic energy is coupled between resonators located at a common intersection of septae, but not immediately adjacent to one another by cross-coupling.

16. A multiplexer as claimed in claim 10 wherein, when it is desired to prevent proximity coupling between two independent one quarter-cut resonators that would otherwise be in the same cavity, an extra septum is inserted to divide what would otherwise by a square cavity in half into two rectangular cavities to prevent such proximity coupling.

17. A multiplexer as claimed in any one of claims 2, 5 or 10 wherein the filter resonates in a $TE_{01\delta}$ mode.

18. A multiplexer as claimed in any one of claims 2, 5 or 10 wherein the filter resonates in a $HE_{11\delta}$ mode.

19. A multiplexer as claimed in claim 10 wherein the multiplexer has two channels and seven cavities, with the total number of independent quarter-cut resonators being equal to eight, said cavities being arranged in a configuration of two large squares overlapping with one another at a common corner cavity, a first, second, third and fourth cavities forming one square and a fourth, fifth, sixth and seventh cavities forming a second square, said fourth cavity being the common cavity and containing the loop coupling, said fourth cavity containing two independent quarter-cut resonators with the remaining cavities of the multiplexer each containing one independent quarter-cut resonator, a first, second, third and fourth quarter-cut resonators being located at a common intersection of septae and being oriented in the form of a circle, a fifth, sixth, seventh, eighth dielectric resonator being located at a common intersection of septae and also being oriented in the form of a circle.

20. A multiplexer as claimed in claim 10 wherein the multiplexer has three channels and eight cavities, with the common cavity containing three independent quarter-cut dielectric resonators, the filter of one channel containing four independent dielectric quarter-cut resonators and four cavities including the common cavity, one resonator being located in each cavity other than the common cavity, a second filter containing four independent dielectric quarter-cut resonators and a total of three cavities, including the common cavity, one cavity other than the common cavity containing two independent quarter-cut resonators, a third filter also containing three cavities including the common cavity and having four quarter-cut resonators, there being two independent quarter-cut resonators in one cavity other than the common cavity.

21. A multiplexer as claimed in claim 10 wherein the multiplexer has three channels and nine cavities, with the common cavity containing three independent quarter-cut resonators, one for each channel, a first channel having four independent quarter-cut resonators in four cavities including the common cavity, there being one resonator per cavity other than the common cavity, except that one cavity other than the common cavity contains a quarter-cut resonator from the first channel together with a quarter-cut resonator from a second channel, the second channel having four independent quarter-cut resonators and four cavities including the common cavity, there being one resonator of the second channel in each of the four cavities, a third channel containing four independent quarter-cut dielectric resonators in four cavities including the common cavity, there being one resonator per cavity except for the common cavity.

22. A multiplexer as claimed in claim 10 wherein the multiplexer has three channels and eight cavities, a first channel containing a filter having three independent quarter-cut resonators and one independent half-cut resonator in a total of three cavities including the common cavity, there being one quarter-cut resonator and one half-cut resonator in one cavity other than the common cavity, a second channel containing a filter with four independent quarter-cut resonators in four cavities including the common cavity, there being one resonator of the second channel per cavity, a third channel containing a filter having three independent quarter-cut resonators and one independent half-cut resonator arranged in a manner similar to the first channel.

23. A multiplexer as claimed in claim 10 wherein the multiplexer has four channels and nine cavities, a first channel having a filter with four independent quarter-cut resonators in three cavities there being two quarter-cut resonators in one of the cavities other than the common cavity and one resonator of the first channel in each of the other two cavities including the common channel, a second channel containing four independent quarter-cut dielectric resonators in three cavities arranged in a manner similar to the first channel, a third channel containing four independent quarter-cut resonators in three cavities arranged in a manner similar to the first channel, a fourth channel containing four independent quarter-cut resonators in three cavities arranged in a manner similar to the first channel, there being four quarter-cut dielectric resonators in the common channel, said multiplexer having a total of sixteen quarter-cut dielectric resonators.

24. A multiplexer as claimed in claim 10 wherein the multiplexer has four channels, a first channel having four independent quarter-cut dielectric resonators in four cavities, there being one resonator of the first channel in each cavity, a second, third and fourth channel each having four independent quarter-cut dielectric resonators arranged in a manner similar to the resonators of the first channel, there being four quarter-cut dielectric resonators, one from each channel in the common cavity, said multiplexer having a total of thirteen cavities and sixteen quarter-cut dielectric resonators.

25. A multiplexer as claimed in any one of claims 3, 6 or 9 wherein the quarter-cut resonators are 45° sectors.

26. A multiplexer as claimed in any one of claims 3, 6 or 8 wherein the half-cut resonators are 180° sectors.

* * * * *